United States Patent [19]

Shurgan et al.

[11] 4,032,813

[45] June 28, 1977

[54] FLUORESCENT LAMP WITH REDUCED WATTAGE CONSUMPTION HAVING ELECTRODE SHIELD WITH GETTER MATERIAL

[75] Inventors: Joel Shurgan, Washington Township, Bergen County; Donald P. Northrop, Glen Rock, both of N.J.

[73] Assignee: Duro-Test Corporation, North Bergen, N.J.

[22] Filed: June 24, 1975

[21] Appl. No.: 589,664

Related U.S. Application Data

[63] Continuation-in-part of Ser. No. 498,552, Aug. 19, 1974, abandoned.

[52] U.S. Cl. ..... 313/492; 313/178; 313/226; 315/DIG. 5

[51] Int. Cl.[2] ..... H01J 61/10; H01J 61/16; H01J 61/44; H01J 61/26

[58] Field of Search ..... 313/178, 484, 485, 492, 313/206, 226; 45/DIG. 5

[56] References Cited

UNITED STATES PATENTS

| | | | |
|---|---|---|---|
| 2,244,070 | 6/1941 | Kurtz | 313/208 |
| 2,622,221 | 12/1952 | Beese | 313/226 X |
| 2,714,684 | 8/1955 | Meister et al. | 313/484 X |
| 2,973,450 | 2/1961 | Ristau | 313/485 X |
| 3,544,829 | 12/1970 | Someya et al. | 313/178 |

*Primary Examiner*—Palmer C. Demeo
*Attorney, Agent, or Firm*—Darby & Darby

[57] ABSTRACT

An energy saving fluorescent lamp utilizing a krypton-neon fill gas mixture and shielded electrode structures having a getter material thereon to operate at a reduced power consumption while serving as a direct replacement for another lamp, consuming a larger amount of energy, with the same ballast transformer. The getter material improves the starting characteristics of the lamps.

7 Claims, 1 Drawing Figure

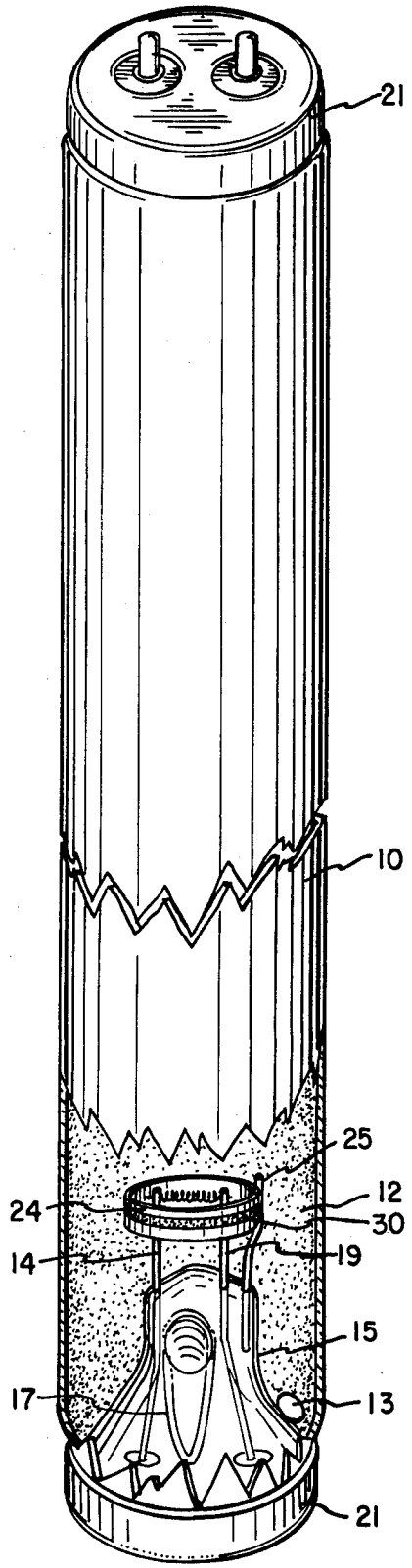
21
10
25
12
24
30
14
19
15
17
13
21

FLUORESCENT LAMP WITH REDUCED WATTAGE CONSUMPTION HAVING ELECTRODE SHIELD WITH GETTER MATERIAL

This application is a continuation-in-part of our copending application Ser. No. 498,552, filed Aug. 19, 1974, now abandoned, entitled Fluorescent Lamp With Reduced Wattage Consumption, which application is assigned to the same assignee.

Fluorescent lamps are well known in the art and are used for a variety of types of lighting installations. Such lamps are characterized as low pressure arc discharge lamps and include an elongated envelope, whose internal wall is coated with a phosphor, and an electrode structure at each end of the envelope. The envelope also contains a quantity of an ionizable material, such as mercury, and a fill gas at low pressure, for example in the order of 1–5 mm of Hg. The fill gas can be, for example argon or krypton, or a mixture of these and other gases. A voltage, usually supplied by a ballast transformer, is applied across the electrodes to ionize the ionizable material in the presence of the fill gas. The resultant ionization and recombination of ions and electrons produces 253.7 nm. radiation which interacts with the phosphor to produce visible light. In general, a fluorescent lamp system produces on the order of from 2–5 times more lumens per watt of energy consumed as compared to an incandescent electric lamp system of comparable wattage.

Fluorescent lamps of a given length and type generally do not vary greatly in the electrical power consumed (watts), especially when operated in conjunction with commercial ballasts. In the past, most attempts to change the power consumption of the lamp-ballast system have been in the direction of increasing the electrical energy requirements to produce a greater light output. However, due to the energy shortage and the increasing cost of purchasing electrical energy, it is becoming increasingly desirable to reduce lighting loads in existing facilities. Various ways of doing this include the use of lower wattage lamps where possible, the elimination of lamps from certain areas, and the reduction of the number of lamps used in a given area.

For incandescent lamp systems, wattage reduction is readily accomplished by substituting for existing lamps lower wattage lamps with the same type of base and with the same voltage rating. However, this generally results in a reduction in the light available. An exception to this is an incandescent lamp of the type manufactured and sold by Duro-Test Corporation, assignee of the subject application, under the trademark WATTSAVER in which the lamp is designed to have the same lumen output as the lamp to be replaced but with this lumen output being produced at a reduced power consumption as compared to the replaced lamp.

For fluorescent lamps it is not easy to directly substitute a lamp of lower wattage. There are several reasons for this, two of the principal ones being that the lamp length must be kept constant and the general complexity of the lamp starting phenomenon. In general, the lamp ballast transformer is uniquely designed for a given lamp and it operates to start the lamp at a relatively high open circuit voltage. After the arc discharge is started, the ballast voltage reduces. The starting of discharge lamps is extremely sensitive to gas composition and, to a lesser degree, to gas fill pressure. Heretofore, the substitution of different gas mixtures for the purpose of obtaining lower operating wattages has, unfortunately, usually made the lamp more difficult to start.

Due to the foregoing, a ballast transformer is designed for a particular type of lamp. That is to say, that it is not ordinarily possible to directly substitute one type of fluorescent lamp for another, i.e. a lamp of reduced wattage or a different gas composition, having different starting and running voltage requirements, for use with a given ballast transformer.

The present invention relates to a novel fluorescent lamp using a unique fill gas mixture in conjunction with an electrode structure which produces an increased lumen output per watt of energy consumed by the lamp while giving the lamp acceptable starting characteristics. In additon, the lamp is directly substitutable in an existing lamp-ballast system without the need for making any changes in either the ballast or its circuit.

In a preferred embodiment of the invention, a mixture of krypton and neon gas is used as the fill gas. In addition, the lamp of the subject invention also utilizes a shielded electrode structure to further reduce the power consumption. A getter material is used in the lamp, preferably on the shield. The getter acts as a scavenger in removing unwanted gases. This has the effect of improving the starting characteristics of the lamp and also aiding in lumen maintenance over the lamp life. The combination provides a lamp which can be substituted directly for another lamp, without change of ballast or fixture, while operating at a reduced wattage consumption and producing a somewhat reduced lumen output than the lamp replaced, but a greater lumen output per watt of energy consumed.

It is therefore an object of the invention to provide a fluorescent lamp for operating at reduced wattage consumption having a krypton-neon fill gas mixture and electrode shields, with the lamp incorporating a getter material. , Other objects and advantages of the present invention will become more apparent upon reference to the following specification and annexed drawings in which:

FIG. 1 is a plan view of a fluorescent lamp made in accord with the present invention.

In order to better understand the present invention, it is instructive to consider the operating characteristics of prior art fluorescent lamps. Consider, for example, two fluorescent lamps, 96 inches long and 1½ inches in diameter, usually referred to as "8 foot slim line lamps" or "96T12 slim lines lamps", made in the conventional manner with pure argon fill gas. These lamps, when operated on a typical ballast transformer, for example a General Electric ballast, Model 8G1490, designed for operation at 120 volts, 60 Hz, will start with as low as 76 volts applied to the input to the ballast. This is well below the requirement that lamps should start at line voltages of at least 10% below the nominal 120 volt line supply. This prior art lamp ballast system (lamps plus ballast transformer) consumes about 186 watts of energy after the two lamps are started.

Table I below shows initial starting line volts and watts consumed during operation for lamps made with different argon-krypton fill gas mixtures. In all cases, starting voltage is not good, in that lamp and manufacturing tolerances and variations would be likely to produce a high reject rate:

TABLE I

| %Argon | %Krypton | Starting Volts | System Watts |
|---|---|---|---|
| 70 | 30 | 100 | 164 |
| 60 | 40 | 124 | 164 |
| 50 | 50 | 128 | 156 |
| 40 | 60 | 129 | 156 |
| 30 | 70 | 132 | 144 |

In accordance with the present invention a novel fluorescent lamp has been developed which can be directly substituted for another lamp without change of or modification in the ballast or its circuit, and which operates at a reduced power consumption while having good starting characteristics. FIG. 1 shows the details of the lamp which, to outward appearances, resembles a conventional fluorescent lamp. It includes an elongated envelope 10 of a transparent vitreous material, such as glass. The inner wall of the envelope is coated by any suitable process, with a phosphor 12 selected to achieve a desired spectral light output. A quantity of an ionizable material 13, such as mercury, is also within the envelope.

An electrode structure 14 is sealed into each end of the envelope. Each structure includes a stem 15 having a tubulation 17 therein through which the envelope is exhausted. A pair of leads 19–20 is mounted on the stem and passes out through the stem for connection to terminals on an end cap 21. A cathode, or filament-cathode, 22 is connected across each pair of leads 19–20. The cathode 22 is of conventional construction, for example coiled or coiled-coil, and it is coated with an electron emissive material.

In accordance with the invention the electrode 22 at each end of the lamp is surrounded by a closed loop of conductive metal strip 24. The trip 24 is not connected to the lamp leads electrically, but is held to the stem 15 by a support lead 25. In the preferred embodiment of the invention, the strip 24 is 6mm wide, and the loop is a generaly elliptical shape with a 20mm major axis and an 8mm minor axis with the electrode 22 in the center along the major axis.

The envelope also includes a fill gas comprising a krypton neon mixture. The ranges of both gases in the mixture are as follows:

krypton — 75% to 90%
neon — 25% to 10%

The gases used in the mixture should be as pure as possible. Other gases, especially nitrogen, should be held below 0.075% and, preferably, lower.

A typical lamp made in accordance with the invention utilizes a fill gas mixture of 80% krypton and 20% neon. A pair of 96T12 lamps made with this gas mixture and the previously described electrode configuration operated with a GE 8G1490 ballast. The original two lamps, having argon gas, and ballast, consumed about 186 watts. Two lamps made in accordance with the subject invention, when directly substituted in the same ballast, had a starting voltage of 80 volts and the system consumed 154 watts. The latter is a reduction of 17.2% over a comparable system wherein the lamps were filled with argon.

Using a reference ballast of 1280 ohms impedance, constructed and connected as described in American National standards Specifications C82-3-1973 and C78.810-1972, lamps made with the aforementioned gas mixture of 80% krypton and 20% neon operated at 61.5 watts and had a light output, in cool white color, of 5530 lumens, giving a lamp efficacy of 89.9 lumens per watt. Lamps made with pure argon as the fill gas and without the strip loop, operated at 75 watts and had a light output of 6130 lumens, giving a lamp efficacy of 81.7 lumens per watt. That is, there was approximately a 10% reduction in the total lumen output, but a 17% reduction in the energy consumed. Similar favorable results were obtained with other gas mixtures within the aforementioned range and the described electrode configuration.

To further improve the operating characteristics of the lamp, a getter material is used as a scavenger for unwanted gases. In the preferred embodiment of the invention, the getter material is coated as a band 30 on the outer side of the metal strip 24. A suitable getter material is, for example, a mixture of zirconium and aluminum in the range of about 84% zirconium and the balance aluminum. The other side of the strip is coated with a mercury dispensing material. The strip is held by the support wires 25 which are welded to the strip and terminate below it.

The lamp is made in the normal manner with the exception that it is not necessary to dose mercury into the envelope. An RF induction heater is placed outside the envelope and heats the strip to a temperature of about 600°–800° F. The heat liberates the mercury from the coating on the inner face of the strip. Adding mercury to the lamp in this manner provides a more precise control of the amount than is available with the normal dosing method. The heat also actuates the getter 30 which scavenges, or picks up, the gas impurities such as oxygen, carbon monoxide, carbon dioxide, and to some extent hydrogen and nitrogen.

The removal of the gas impurities improves the starting characteristics of the lamp. A fluorescent lamp with a krypton-neon gas mixture is rather difficult to start. Some of the difficulty is due to the presence of the gas impurities, particularly oxygen. The getter removes oxygen as well as other gas impurities.

The getter continues to function during operation of the lamp, picking up any further impurities liberated. The original and continuing functioning of the getter helps lumen maintenance by reducing the blackening of the envelope wall.

As should be apparent from the foregoing, the lamps of the present invention not only reduce power consumption, but also utilize power more efficiently. In addition, the gas mixture affords good starting characteristics. While the invention has been described with respect to a particular size fluorescent lamp, it should be understood that it also can be utilized with various sizes of lamps of different diameters and lengths.

What is claimed is:

1. An energy saving fluorescent lamp for use with an existing ballast system designed for operation at a predetermined magnitude input voltage with a standard wattage rating fluorescent lamp, said energy saving fluorescent lamp comprising an envelope having a phosphor on the internal wall thereof, an electrode for emitting electrons and collecting ions at each end of the envelope, leads for connecting the electrodes to the existing ballast as source of electric current to energize the same, an ionizable mercury medium within said envelope, a fill gas in said envelope consisting essentially of krypton in the range of from about 75% to 90% and neon in the range from about 25% to 10%, an electrically conductive means insulated from the electrical connection to the electrodes surrounding each of said electrodes, and a getter material in said envelope for scavenging gas impurities, said fill gas and electrodes cooperating to start said lamp at a voltage at least 10% below said predetermined magnitude and to ionize the mercury to operate said lamp to produce light output when connected to said ballast and consuming at least about 10% less energy than the standard wattage rating fluorescent lamp for which the ballast system was designed, the loss in light output produced by the lamp being less than the light output which would be lost if the standard lamp were operated at the corresponding reduced energy consumption.

2. An energy saving fluorescent lamp as in claim 1 wherein the getter material is located on at least one of said conductive means.

3. An energy saving fluorescent lamp as in claim 2 wherein said getter material is coated on said conductive means as a band of lesser width than the conductive means.

4. An energy saving fluorescent lamp as in claim 3 wherein each said conductive means is of generally elliptical shape.

5. An energy saving fluorescent lamp as in claim 4 wherein each said conductive means is a strip of metal.

6. An energy saving fluorescent lamp as in claim 1 wherein said fill gas mixture comprises 80% krypton and 20% neon.

7. An energy receiving fluorescent lamp as in claim 1 wherein said gas fill mixture contains less than 0.075% of other gases.

* * * * *